US009101182B2

(12) United States Patent
Kozato et al.

(10) Patent No.: US 9,101,182 B2
(45) Date of Patent: Aug. 11, 2015

(54) METAL DOUBLE-SIDED TOOTH AND SLIDE FASTENER

(75) Inventors: Futoshi Kozato, Toyama (JP); Yusuke Meiwa, Toyama (JP); Hirofumi Tanikoshi, Toyama (JP)

(73) Assignee: YKK Corporation (JP)

( * ) Notice: Subject to any disclaimer, the term of this patent is extended or adjusted under 35 U.S.C. 154(b) by 339 days.

(21) Appl. No.: 13/635,430

(22) PCT Filed: Apr. 28, 2010

(86) PCT No.: PCT/JP2010/057586

§ 371 (c)(1),
(2), (4) Date: Sep. 16, 2012

(87) PCT Pub. No.: WO2011/135699

PCT Pub. Date: Nov. 3, 2011

(65) Prior Publication Data

US 2013/0007993 A1 Jan. 10, 2013

(51) Int. Cl.

| | |
|---|---|
| ***A44B 19/02*** | (2006.01) |
| ***A44B 19/06*** | (2006.01) |
| ***A44B 19/24*** | (2006.01) |
| ***A44B 19/38*** | (2006.01) |

(52) U.S. Cl.

CPC ..... *A44B 19/06* (2013.01); *A44B 19/24* (2013.01); *A44B 19/382* (2013.01); *Y10T 24/2561* (2015.01)

(58) Field of Classification Search

CPC ..... A44B 19/06
USPC ..... 24/409–411, 403, 414
See application file for complete search history.

(56) References Cited

U.S. PATENT DOCUMENTS

| | | | | |
|---|---|---|---|---|
| 2,748,440 | A * | 6/1956 | Ulrich | 24/409 |
| 3,634,915 | A * | 1/1972 | Alberts | 24/402 |
| 4,937,922 | A | 7/1990 | Okazaki | |

(Continued)

FOREIGN PATENT DOCUMENTS

| | | | |
|---|---|---|---|
| CN | 1659991 | A | 8/2005 |
| CN | 101327059 | A | 12/2008 |

(Continued)

OTHER PUBLICATIONS

International Search Report, PCT Intenrational Application No. PCT/JP2010/057586, mailed Apr. 28, 2010.

(Continued)

*Primary Examiner* — Robert J Sandy
*Assistant Examiner* — Matthew Sullivan
(74) *Attorney, Agent, or Firm* — Kilpatrick Townsend & Stockton LLP

(57) ABSTRACT

Provided are a metal double-sided tooth that prevents a flow protruding portion from protruding from the boundary between a coupling concave portion and a body, and a slide fastener using the metal double-sided tooth. The inner side of a coupling concave portion is formed in a substantially bowl shape and a concave portion is formed throughout the boundary between the coupling concave portion and a body and a front side and a rear side of the body. Further, when the metal double-sided tooth is attached to a fastener tape, it is possible to prevent a flow protruding portion generated by caulking a pair of legs from protruding outward from the coupling concave portion or the front side and the rear side of the body until sliding friction is generated in a slider.

7 Claims, 7 Drawing Sheets

(56) References Cited

U.S. PATENT DOCUMENTS

| | | | | |
|---|---|---|---|---|
| 7,322,075 | B2 * | 1/2008 | Ozaki et al. | 24/414 |
| 7,665,193 | B2 * | 2/2010 | Hasegawa et al. | 24/410 |
| 7,788,773 | B2 * | 9/2010 | Morioka et al. | 24/403 |
| 2005/0183246 | A1 | 8/2005 | Ozaki et al. | |
| 2008/0313867 | A1 * | 12/2008 | Morioka et al. | 24/403 |
| 2009/0013505 | A1 * | 1/2009 | Hasegawa et al. | 24/400 |

FOREIGN PATENT DOCUMENTS

| | | | |
|---|---|---|---|
| DE | 3875089 | A | 5/1993 |
| DE | 69310819 | T2 | 12/1997 |
| EP | 320912 | A1 | 6/1989 |
| EP | 1568422 | A1 | 8/2005 |
| EP | 2005852 | A2 | 12/2008 |
| JP | 1-160502 | A | 6/1989 |
| JP | 55-14252 | A | 4/1990 |
| JP | 6-23456 | A | 2/1994 |
| JP | 2005-237532 | A | 9/2005 |
| JP | 2009-000222 | A | 1/2009 |
| KR | 10-2006-0043100 | A | 5/2006 |
| KR | 10-2008-0112133 | A | 12/2008 |

OTHER PUBLICATIONS

International Search Report, PCT International Application No. PCT/JP2010/057586, mailed Apr. 28, 2010.

* cited by examiner

METAL DOUBLE-SIDED TOOTH AND SLIDE FASTENER

This application is a national stage application of PCT/JP2010/057586 which is incorporated herein by reference.

TECHNICAL FIELD

The invention relates to a metal double-sided tooth having a coupling convex portion and a coupling concave portion on both sides of a coupling head, respectively, and a slide fastener having the metal double-sided tooth.

BACKGROUND ART

A slide fastener is widely used in openings of bags or the like to open/close them. As the slide fastener, a both-open type slide fastener in which two sliders are disposed at a pair of fastener stringers for head fitting or tail fitting or a one-open type slide fastener in which one slider is disposed has been known.

In the both-open type slide fastener, the slide fastener can be opened/closed even by sliding two sliders in any direction of forward and backward directions along the tooth line. Further, in the one-open type slide fastener, the slide fastener can be opened/closed by sliding the slider.

As a tooth that is attached to slide fasteners such as the both-open type slide fastener or the one-open type slide fastener, there is a matter using a metal double-sided tooth. It is possible to achieve a slide fastener that is strong against horizontal pulling strength, has a metal shiny surface, and has excellent external appearance by using the metal double-sided tooth. For the shape of the metal double-sided tooth, a coupling convex portion and a coupling concave portion are all formed on both sides of the coupling head. The coupling convex portion that is formed on a counterpart side for coupling may be coupled to the coupling concave portion.

As an example of the metal double-sided tooth, the present applicant(s) has proposed a tooth of a slide fastener configured by a metal double-sided tooth formed by forming (see Patent Document 1). FIG. 9 illustrates a perspective view of a metal double-sided tooth described in Patent Document 1, as an example of the related art in the invention. As illustrated in FIG. 9, a metal double-sided tooth 50 includes a coupling head 51, a body 52 disposed at the rear end of the coupling head 51, and a pair of left and right legs 53 extending from the rear end of the body 52.

The coupling head 51 has a thin flat plate portion 57, a pair of coupling protruding portions 54, a pair of left and right side protruding portions 55, and a pair of coupling concave portions 56. The thin flat plate portions 57 are formed at the center portions of both front and rear sides of the body 52 and are formed to be thinner than the plate thickness of the body 52. The pair of coupling protruding portions 54 protrudes from both of front and rear sides at the left and right center portions of the thin flat plate portion 57.

The pair of left and right side protruding portions 55 extend from the thin flat plate portions 57 disposed at the left and right of the coupling convex portions 54 toward both of the front and rear sides of the body 52, and are integrally formed with the body 52. Further, the pair of coupling concave portions 56 is formed as the region surrounded by the coupling convex portions 54, the side protruding portions 55, and the body 52. The coupling convex portion 54 that is a counterpart for coupling may be coupled to the coupling concave portion 56.

PRIOR ART DOCUMENT

Patent Document

Patent Document 1: Japanese Patent Application Laid-Open No. 55-14252

SUMMARY OF THE INVENTION

Problems to be Solved by the Invention

Describing the invention described in Patent Document 1, in the metal double-sided tooth proposed in the related art, it is possible to attach the metal double-sided teeth 50 at a predetermined distance on the end edge of a fastener tape by caulking the portion between the pair of legs 53 of the metal double-sided tooth 50. When the portion between the pair of legs 53 is caulked, metal flows at the body 52 and the flowing metal forms a flow protruding portion 58 to protrude from the body 52.

In particular, when the metal double-sided tooth 50 is manufactured by using aluminum or an aluminum alloy, the amount of flowing metal is larger and the height of the flow protruding portion 58 is larger than those when the metal double-sided tooth 50 is manufactured by using copper or a copper alloy. Further, the flow protruding portion 58 formed by flowing metal may protrude into the coupling concave portion 56 or protrude outward further than the front side 52*a* and the rear side (not illustrated) of the body 52, at the boundary of the coupling concave portion 56 and the body 52.

The flow protruding portion 58 protruding by the flowing metal is described with reference to FIGS. 10A and 10B. FIG. 10A is a plan view illustrating the state before the metal double-sided tooth 50 illustrated in FIG. 9 is caulked and FIG. 10B is a plan view illustrating the state after the metal double-sided tooth 50 illustrated in FIG. 9 is caulked.

By caulking the metal double-sided tooth 50, as illustrated in FIG. 10B, the flow protruding portion 58 protrudes into the coupling concave portion 56 or outward further than the front side 52*a* and the rear side (not illustrated) of the body 52 from the boundary between the coupling concave portion 56 and the body 52. In this state, when the coupling convex portion 54 of the metal double-sided tooth 50 which is a counterpart for coupling is coupled to the coupling concave portion 56, the flow protruding portion 58 becomes an obstacle that interferes with coupling.

Further, when the flow protruding portion protrudes outward further the front side and the rear side of the body, the gap between adjacent double-sided teeth is increased by the flow protruding portion in coupling or the flow protruding portion interferes with sliding of the slider.

As described above, when the flow protruding portion 58 protrudes in the coupling concave portion 56 from the boundary between the coupling concave portion 56 and the body 52 or the flow protruding portion protrudes outward further than the front side and the rear side of the body, the flow protruding portion 58 acts as sliding friction in the slider fastener.

It is considered to perform machining for removing the flow protruding portion 58 formed on the boundary between the coupling concave portion 56 and the body 52 or the front side 52*a* and the rear side of the body 52 after forming a fastener stringer, but it takes time and labor to remove the flow protruding portion 58 from both sides of the metal double-sided tooth 50. Further, it was difficult to completely remove the flow protruding portion 58 from both sides of the metal double-sided tooth 50.

Therefore, it is an object of the invention to provide a metal double-sided tooth that prevents a flow protruding portion from protruding outward further than the front side 52*a* and the rear side (not illustrated) of the body 52 from the boundary between the coupling concave portion and the body, and provide a slide fastener using the metal double-sided tooth.

Means for Solving the Problems

The invention provides a metal double-sided tooth having a coupling head, a body disposed at the rear end of the coupling head, and a pair of left and right legs extending from the rear end of the body, on a front side and a rear side of a flat plate portion, in which the coupling head has the flat plate portion having a thickness of a plate between the front side and the rear side which is smaller than the thickness of the plate of the body, a pair of coupling convex portions protruding from a front side and a rear side of the flat plate portion, a pair of left and right side protruding portions protruding toward the front side and the rear side of the body from the flat plate portions disposed at the left and right of the coupling convex portions, respectively, and integrally formed with the body, and a pair of coupling concave portions surrounded by the coupling convex portions, the side protruding portions, and the body and formed on the front side and the rear side of the flat plate portion, and a concave portion is formed on a boundary between the coupling concave portion and the body.

Further, in the metal double-sided tooth of the invention, the concave portion is formed in a shape of a concave portion having a bottom and being open to the coupling convex portions and to the up and down of the metal double-sided tooth.

In addition, in the metal double-sided tooth of the invention, the concave portion is formed in a shape of a concave portion of which at least the bottom is formed in a tetragonal shape when seen from above and which has three sides surrounding three sides of the bottom.

Furthermore, in the metal double-sided tooth of the invention, the dimension in the left-right width direction of the concave portion is not more than the length of a side at the coupling concave portion of the bottom and is not less than the length in the left-right direction at the top of the coupling convex portion.

Further, in the metal double-sided tooth of the invention, assuming an intersection line of a surface perpendicular to the bottom including the side at the coupling concave portion of the bottom and a body-extending surface of the front side or the rear side of the body, the dimension in the front-rear direction of the concave portion is the length that is 40% to 60% of the minimum distance between the intersection line and the rear edge of the body.

In addition, in the metal double-sided tooth of the invention, a dimension in the depth direction of the concave portion is a length that is 10% to 50% of the depths of the coupling concave portions.

Furthermore, in the metal double-sided tooth of the invention, assuming that the concave portion is not formed and the boundary is formed up to the upper surface of the body, and assuming a volume in the body which is surrounded by a flat plate-extending surface extending the front side or the rear side of the flat plate portion, a rear side which is a surface parallel with a surface perpendicular to the flat plate-extending surface and passes a portion closest to the coupling head at the rear edge of the body, and a pair of sides that include an intersection line between the boundary and the side protruding portions and are vertical surfaces from the rear side, when the volume is a volume of 100%, the concave portion is formed to have a volume that is 5% to 13% of the volume.

Further, a slide fastener of the invention includes a pair of fastener stringers in which the metal double-sided teeth of the invention are arranged at a predetermined distance at a side of a fastener tape.

Effect of the Invention

In the metal double-sided tooth of the invention, the concave portion is formed at the boundary. When the metal double-sided tooth is attached to an end edge of the fastener tape, the flow protruding portion is formed by flow of metal due to caulking generated at the body. Even if the flow protruding portion protrudes to the coupling concave portion, the flow protruding portion is prevented from protruding to the coupling concave portion by the concave portion until sliding friction of the slider increases.

Further, even if the flow protruding portion protrudes outward further than the front side and the rear side of the body, the flow protruding portion can be prevented from protruding by the concave portion until the gap between adjacent double-sided teeth is increased by the flow protruding portion in coupling or when the flow protruding portion protrudes to a sliding path of the slider to interfere with sliding of the slider. In addition, the gap between adjacent double-sided teeth can be aligned to be situated at a correct coupling position and the sliding friction of the slider can be prevented from increasing by the concave portion.

As described above, the concave portion of the invention functions as a shock-absorbing portion for the flow protruding portion.

In the invention, as the concave portion is formed, even if the flow protruding portion that resists sliding of the slide fastener protrudes to the coupling concave portion, it is possible to prevent the flow protruding portion from protruding to the coupling concave portion, in order not to interfere with the coupling between the coupling concave portion and the coupling convex portion that are coupled.

Further, as the concave portion is formed, even if the flow protruding portion protrudes outward further than the front side and the rear side of the body, it is possible to keep the gap between adjacent double-sided teeth at the correct coupling position gap. In addition, it is possible to prevent sliding friction against the slider which is generated by protrusion of the flow protruding portion.

Further, as the configuration of attaching the metal double-sided tooth to the fastener tape, a configuration of directly attaching the metal double-sided tooth to an end edge of the fastener tape and a configuration of attaching the metal double-sided tooth to a core thread formed at the end edge of the fastener tape may be implemented.

In the invention, the concave portion may be formed in a shape of a concave portion having a bottom and being open to the coupling convex portions and to the up and down of the metal double-sided tooth. Further, the concave portion may be formed in a shape of a concave portion of which at least the bottom is formed in a tetragonal shape when seen from above and which has three sides surrounding three sides of the bottom. The shape of the concave portion may be specified as described above.

Further, the dimension in the left-right width direction of the concave portion having a tetragonal bottom when seen from above is not more than the length of a side at the coupling concave portion of the bottom and is not less than the length in the left-right direction at the top of the coupling convex portion.

When the dimension in the left-right width direction of the concave portion is a length larger than the dimension of the side at the coupling concave portion of the bottom, strength is decreased at the coupling head. Further, it is necessary to form a male mold portion in a mold for forming the metal double-sided tooth by forming and the front end of the male mold portion may be cut.

Further, when the dimension in the left-right width direction of the concave portion is a length smaller than the length in the left-right direction at the top of the coupling concave portion, it is difficult to achieve the shock-absorbing function for preventing the flow protruding portion from protruding to the coupling concave portion, from the concave portion.

Therefore, it is preferable that the dimension in the left-right width direction of the concave portion is made as a length within the dimensional range described above.

Further, assuming an intersection line between the body-extending surface and the vertical surface including the side of the coupling concave portion of the bottom as the minimum distance between the side of the coupling concave portion of the concave portion and the side of the body, the minimum distance may be made to be a length of 40% to 60% of the minimum distance between the intersection line and the rear edge of the body.

When the minimum distance between the side of the coupling concave portion of the concave portion and the side of the body is less than 40% of the minimum distance between the intersection line and the rear edge of the body, the flow protruding portion further expands and greatly protrudes further than the boundary between the coupling concave portion and the body when the metal double-sided tooth is attached to the fastener tape, so that the sliding friction of the slider is increased.

Further, when the minimum distance is larger than 60%, attachment strength of the metal double-sided tooth to the fastener tape reduces. That is, the gap between the front end and rear end of the body decreases, where strength is reduced.

The dimension in the depth direction of the concave portion may be a length that is 10% to 50% of the depth from the front side or the rear side of the body at the coupling concave portions. When the depth is less than 10% of the depth of the coupling concave portion, it is difficult to prevent the amount of protrusion of the flow protruding portion at the coupling concave portion in order to prevent sliding friction of the slider. Further, as the flow protruding portion greatly protrudes into the coupling concave portion, sliding friction of the slider is generated. In addition, when the depth is larger than 50% of the depth of the coupling concave portion, it may be difficult to stably couple the coupling convex portion into the coupling concave portion at the coupling place.

Further, in the invention, it is possible to define the volume of the concave portion as follows. That is, assuming a volume in the body surrounded by a flat plate-extending surface extending the front side or the rear side of the flat plate portion, a rear side, and a pair of sides when the concave portion is not formed, when the volume is a volume of 100%, the concave portion may be configured to have a volume that is 5% to 13% of the volume.

As the volume of the concave portion is configured to be within the volume range, a column-shaped concave portion surrounded by an arc and a chord when seen from above may be configured, as the shape of the concave portion. Further, the concave portion may be formed as a column-shaped concave portion formed in a partial shape on the circumference of an ellipse or a parabolic shape, instead of the arc shape, when seen from above. In addition, the concave portion may be configured to have a shape with a concave surface on the bottom.

It is possible to manufacture a slider fastener, using the metal double-sided tooth according to the invention. By this configuration, it may be possible to configure a slide fastener that can considerably improve sliding performance of a slider.

MODE FOR CARRYING OUT THE INVENTION

Hereinafter, embodiments of the invention are described in detail with reference to the drawings. Further, the invention is not limited to the embodiments described below and may be modified in various ways as long as it has substantially the same configuration and the same operational effects.

Embodiment

In the invention, a front-rear direction of a metal double-sided tooth means a direction corresponding to the width direction of a tape when the metal double-sided tooth is attached to a fastener tape, a direction to a coupling head is the front direction and a direction to the fastener tape is the rear direction. Further, a left-right direction of the metal double-sided tooth means a direction of the front and rear sides of the tape when the metal double-sided tooth is mounted on the fastener tape, and an up-down direction of the metal double-sided tooth is the longitudinal direction of the tape when the metal double-sided tooth is mounted on the fastener tape.

Figure 1:
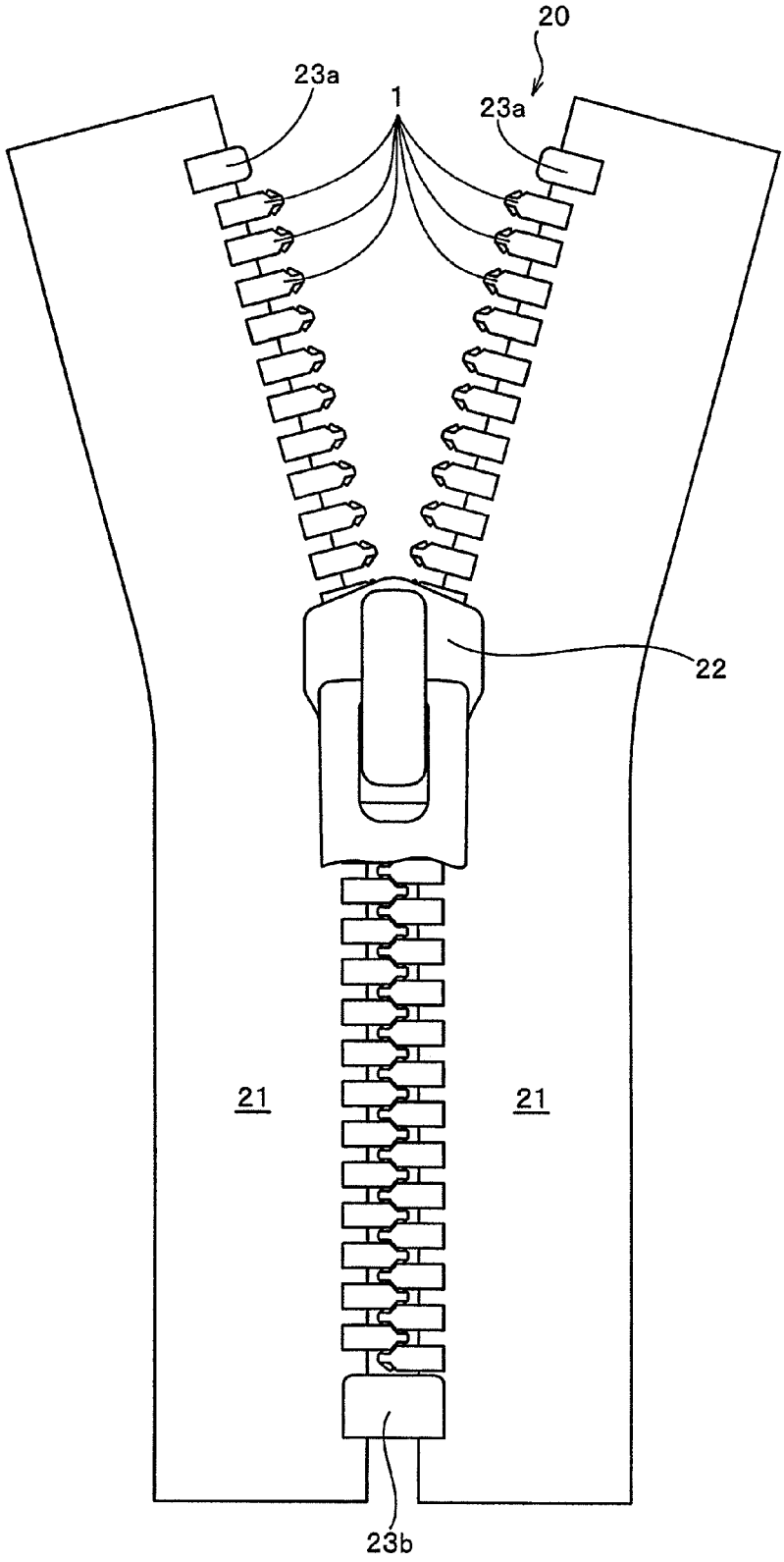
FIG. 1 is a plan view of a slide fastener (Embodiment).

FIG. 1 is a plan view of a slide fastener using the metal double-sided tooth according to an embodiment of the invention. A slide fastener 20 includes a pair of fastener stringers 21 formed by attaching a metal double-sided tooth 1 to an end edge of the fastener tape at a predetermined distance, a slider 22 opening/closing the portion between the pair of fastener stringers 21, and an upper stopper 23*a* and a lower stopper 23*b* that restrict the sliding range of the slider 22.

Although a configuration in which a metal double-sided tooth is attached to the end edge of a fastener tape is illustrated, a metal double-sided tooth may be attached to a core thread formed at the end edge of a fastener tape.

Further, the slide fastener 20 can be opened/closed by sliding the slider 22. In the example illustrated in the drawings, a configuration example in which the metal double-sided tooth 1 is attached to a one-open type slide fastener is illustrated, but the metal double-sided tooth 1 according to the invention may be appropriately applied even to a both-open type slide fastener or a slide fastener with an open separation bottom end stop.

The invention is characterized in the configuration of the coupling head 3 of the metal double-sided tooth 1, but the entire configuration of the metal double-sided tooth 1 may be manufactured by using metal such as copper, a copper alloy, aluminum, and an aluminum alloy in the methods known in the art.

That is, the metal double-sided tooth 1 may be continuously manufactured by pressing a metal plate one or more times and punching the pressed metal plate in the outer shape of the metal double-sided tooth 1. Alternatively, the metal double-sided tooth 1 may be continuously manufactured by cutting a metal bar called Y-bar to have a predetermined thickness and pressing the coupling head 3 of the cut tooth in the up-down direction.

Figure 2:
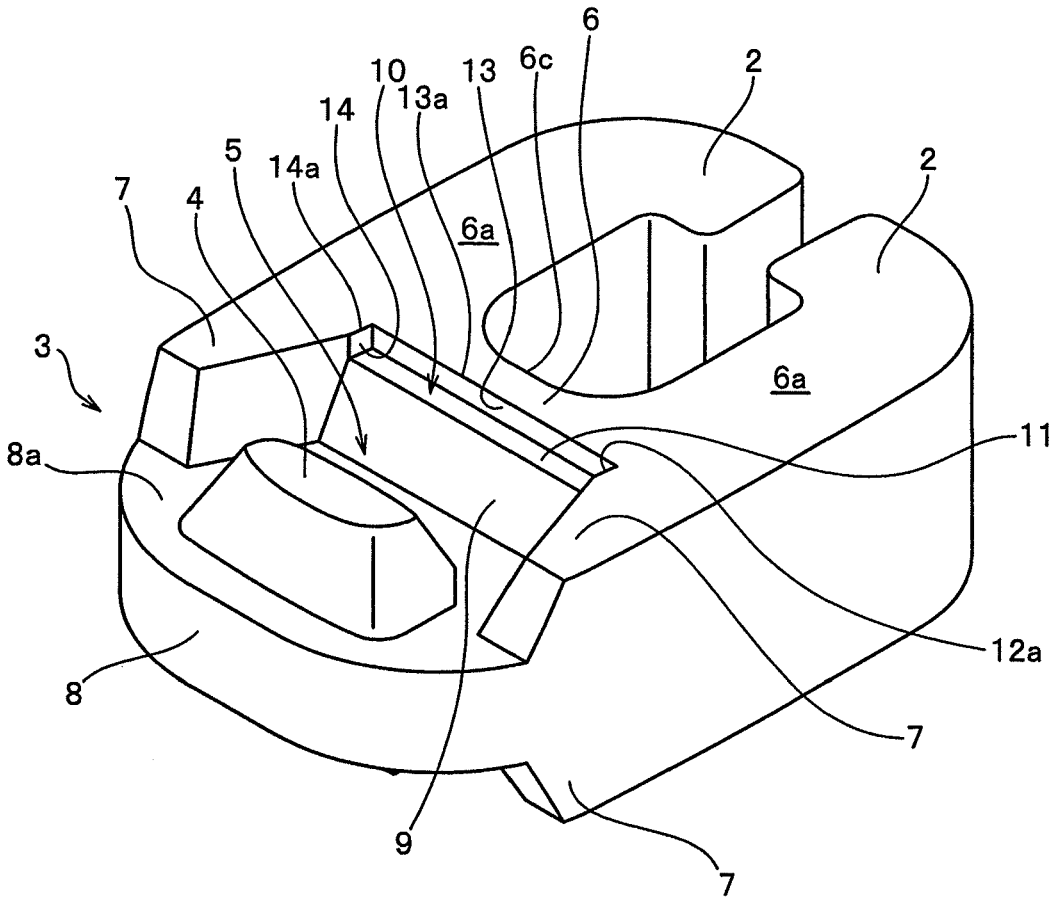
FIG. 2 is a perspective view of a metal double-sided tooth (Embodiment).

By performing the pressing described above, it is possible to manufacture the metal double-sided tooth 1 having the coupling head 3, a body 6 disposed at the rear end of the coupling head 3, and a pair of left and right legs 2 extending from the rear end of the body 6, as illustrated in FIG. 2. The coupling head 3 is configured to have a flat plate portion 8, a pair of coupling convex portions 4, a pair of left and right side protruding portions 7, and a pair of coupling concave portions 5 which are disposed in the same way on both front and rear sides of the coupling head 3.

Further, a concave portion 10 which is described below is formed throughout a boundary 9 between the coupling concave portion 5 and the body 6, and a front side 6*a* and a rear side 6*b* of the body 6. The boundary 9 is configured by an inclined surface which is a side of the body 6 and goes toward the front side 6*a* and the rear side 6*b* of the body 6 from a front side 8*a* and a rear side 8*b* of the flat plate portion 8.

The flat plate portion 8 is formed to be positioned around the coupling convex portion 4 and to be thinner than the plate thickness between the front side 6*a* and the rear side 6*b* of the body 6. The pair of coupling convex portions 4 protrude from the front side 8*a* and the rear side 8*b* of the flat plate portion 8, respectively, at the left and right center portions of the flat plate portion 8, and a flat surface having substantially the same height as those of the front side 6*a* and the rear side 6*b* of the body 6 is formed at the top of the pair of coupling convex portions 4.

The pair of left and right side protruding portions 7 extend from the flat plate portions 8 disposed at the left and right of the coupling convex portion 4 toward the front side 6*a* and the rear side 6*b* of the body 6 and are integrally formed with the body 6. Further, the pair of coupling concave portions 5 is formed to be surrounded by the coupling convex portion 4, the side protruding portions 7, and the body 6, respectively. The coupling convex portion 4 that is the counterpart for engagement can be coupled to the coupling concave portion 5.

The surfaces of the protruding portions 7 and the front side 6*a* and the rear side 6*b* of the body 6 are formed on the same plane and the protruding portions 7 are gradually inclined from the rear portion to the front portion.

Figure 3:
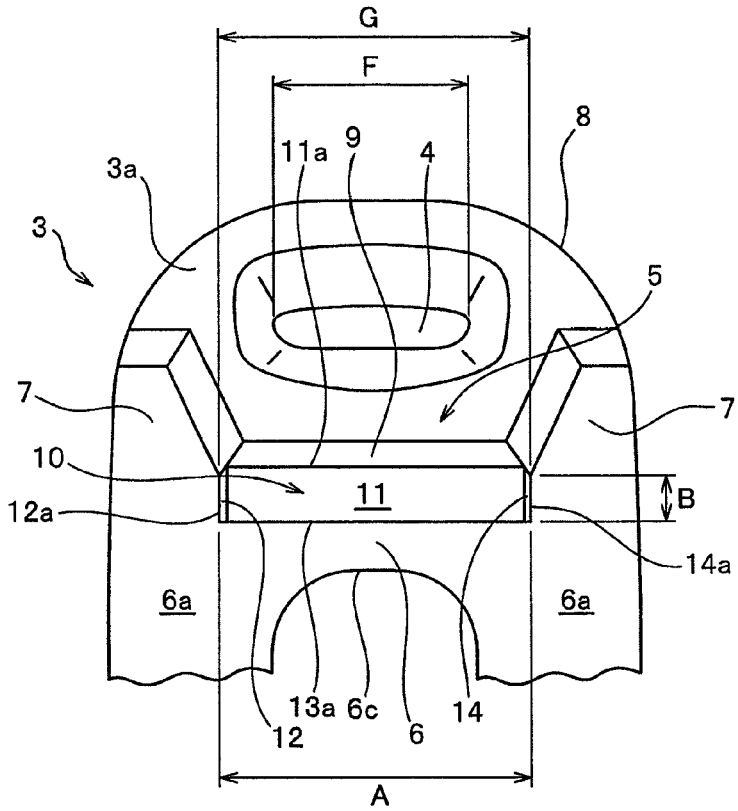
FIG. 3 is a plan view illustrating the main parts of a coupling head (Embodiment).
Figure 4:
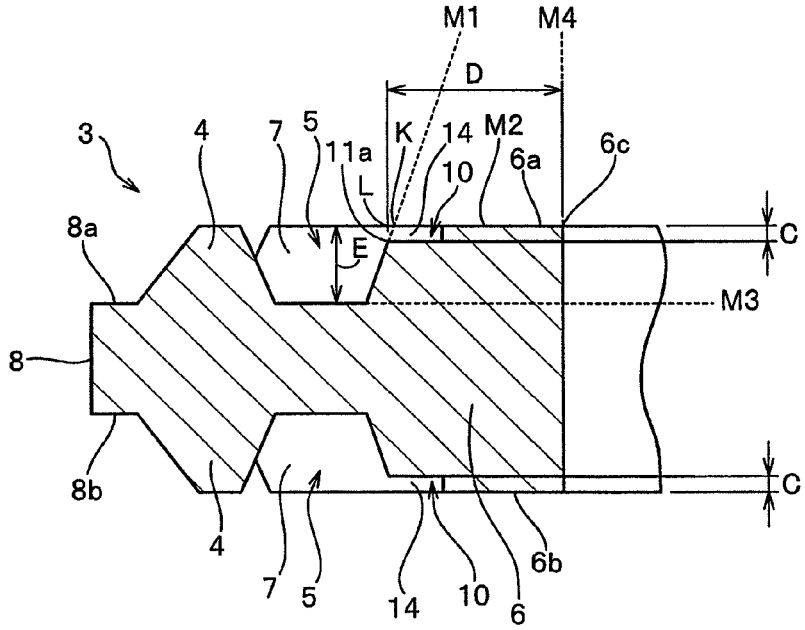
FIG. 4 is a cross-sectional view illustrating the main parts of the coupling head (Embodiment).

The inner side of the coupling concave portion 5, as illustrated in FIGS. 2 to 4, is formed such that the coupling convex portion 4 and the side protruding portions 7 are spaced, but has a substantially bowl shape. Further, the coupling concave portion 5 is formed in a shape which expands and opens outward from the bottom.

Figure 10:
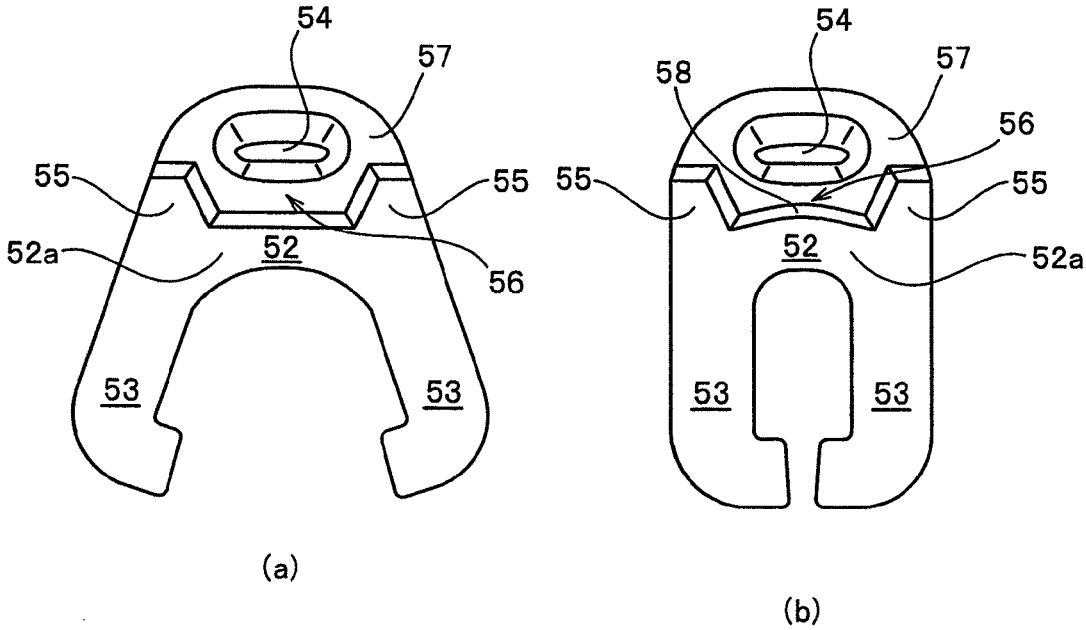
FIG. 10 is a plan view illustrating the state in caulking.

As illustrated in FIGS. 2 to 4, the concave portion 10 is formed throughout the boundary 9 between the coupling concave portion 5 and the body 6, and the front side 6*a* and the rear side 6*b* of the body 6. By forming the concave portion 10, as illustrated in FIG. 10B, a flow protruding portion is formed when the pair of legs 2 are caulked, and even if the flow protruding portion protrudes in the coupling concave portion 5 or outward further than the front side 6*a* and the rear side 6*b* of the body 6, it is possible to prevent the flow protruding portion from protruding until sliding friction of a slider increases. That is, the concave portion of the invention functions as a shock-absorbing part that does not protrude the flow protruding portion to the coupling concave portion until the sliding friction of the slider increases.

By this configuration, it is possible to prevent the flow protruding portion, which protrudes from the body 6 of the metal double-sided tooth 1, from greatly protruding, when attaching the metal double-sided tooth 1 to the end edge of a fastener tape by caulking the pair of legs 2 of the metal double-sided tooth 1.

Further, in the metal double-sided tooth 1 illustrated in FIGS. 1 to 4 and FIGS. 6 to 8, the pair of legs 2 are caulked, but it is difficult to show the shape of the concave portion 10 when illustrating the flow protruding portion, so that the flow protruding portion generated when the pair of legs 2 are caulked, which is illustrated in FIG. 10B, is not illustrated in FIGS. 1 to 4 and FIGS. 6 to 8.

As for the shape of the concave portion 10, as illustrated in FIGS. 3 and 4, the sides of a tetragonal bottom 11 are configured as tetragonal sides 12 and 14 when seen from above, the inner side 13 is formed in a rectangular shape that is one of tetragonal shapes, and only three sides of the bottom 11 may be surrounded by the sides 12 to 14.

Further, the shape of the inner side 13 is not limited to the rectangular shape that is one of tetragonal shapes and the shape of the concave portion 10 may be configured in a shape expanding and opening outward from the bottom 11 of the concave portion 10. In addition, it is preferable that the tetragonal shape is a trapezoidal shape, as illustrated in FIG. 8B. Furthermore, the tetragonal shape means a shape with four sides and four angles and the trapezoidal shape means a tetragonal shape with the two opposite sides of at least one set in parallel, in sets of two opposite sides. Here, the trapezoidal shape is employed.

Further, when making an imaginary tetragonal shape composed of upper sides 12*a* to 14*a* of the tetragonal sides 12 to 14 and a first intersection line K of an extending boundary M1 that is an extending surface of the boundary 9 and a body-extending surface M2 that is an extending surface of the front side 6*a* or the rear side 6*b* of the body 6, it is preferable that the length A of an upper side 13*a* that is the side adjacent to the body 6 is not more than the length G of a side 11*a* adjacent to the coupling concave portion 5 of the bottom 11, that is, an intersection gap G between the side 11*a* and the inner sides of the side protruding portions 7.

In addition, although the range of configuring the length A using the length A of the upper side 13*a* is described, the average length of the width direction of the concave portion 10 may be determined as the length A.

Furthermore, it is preferable that the length A of the upper side 13*a* is not less than the length F in the left-right direction of the coupling convex portion 4. That is, it is preferable to satisfy the relationship, $G \geq A \geq F$. In this configuration, the length F is determined by the length in the left-right direction of the coupling convex portion 4, but when it is difficult to determine like this, it may be possible to cut the coupling convex portion 4 along a plane that is in parallel with the body-extending surface M2 including the plane where the bottom 11 is formed, and determine the length F as the length in the left-right direction on the cut surface, by using the cut surface of the coupling convex portion 4.

When the length A of the upper side 13*a* is longer than the length G of the side 11*a* of the bottom 11, the gap between both ends of the upper side 13*a* and the outer side in the left-right direction of the metal double-sided tooth 1 is made small. Further, the concave portion 10 is formed to extend in the left-right direction further than the intersection between the inner side of the side protruding portions 7 and the side 11*a*. Therefore, strength decreases at the coupling head 3 including the side protruding portions 7.

Further, it is necessary to form a male mold portion in a mold for forming the metal double-sided tooth 1 by forming and the front end of the male mold portion may be cut.

In addition, considering the life span of the mold for forming the metal double-sided tooth 1, it is possible to simplify the shape of the mold and increase the life span of the mold, by making the length A the same as the intersection gap between the inner sides of the side protruding portions 7 and the side 11*a*.

Further, when the length A of the upper side 13*a* is shorter than the length F, the shock-absorbing function of the concave portion 10 for the flow protruding portion reduces.

In the invention, assuming an intersection line L when the vertical surface including the side 11*a* of the bottom 11 and the body-extending surface M2 cross each other, it is preferable that the minimum distance B between the first intersection line K, which is the length of the upper side 12*a* or the upper side 14*a* of the sides 12 and 14 extending from the bottom 11, and the upper side 13*a* adjacent to the body 6 of the imaginary tetragonal shape is determined to be 40% to 60% of the minimum distance D between the intersection line L and a rear edge 6*c* of the body 6.

In other words, it is preferable that the front-rear length B of the concave portion 10 satisfy the relationship $0.6\times D \geq B \geq 0.4\times D$, for the maximum distance D of the body 6 in the front-rear direction, in the same way.

Further, the shape of typical teeth is configured such that a pair of legs is adjacent to each other, with the center in the left-right direction as a shiny surface target. That is, the length in the front-rear direction of the body 6 is the minimum distance D, on the center line in the left and right direction of the teeth.

When the length B of the upper side 12*a* or the upper side 14*a* is less than 40% of the minimum distance D, the flow protruding portion further expands when the metal double-sided tooth 1 is attached to the fastener tape, so that the flow protruding portion further protrudes toward the coupling concave portion 5 than the boundary 9 between the coupling concave portion 5 and the body 6.

Further, the flow protruding portion that greatly protrudes toward the coupling concave portion 5 interferes with coupling of the coupling concave portion 5 and the coupling convex portion 4 that is a counterpart coupled to the coupling concave portion 5. That is, the flow protruding portion that greatly protrudes toward the coupling concave portion 5 protrudes into the coupling region of the coupling concave portion 5 and the coupling convex portion 4 that is the counterpart coupled to the coupling concave portion 5.

Further, the gap between adjacent double-sided teeth is increased in coupling, by the flow protruding portion that protrudes outward further than the front side and the rear side of the body. Alternatively, it interferes with the sliding region of the slider.

As a result, sliding friction of the slider in the slide fastener is deteriorated. Further, when the length B is made larger than 60% of the minimum distance D, the gap between the upper side 13*a* and the rear edge 6*c* of the body 6 becomes narrow, so that strength reduces at the narrow portion. In addition, the attachment strength of the metal double-sided tooth 1 to the fastener tape reduces.

In the invention, it is preferable that the depth C of the concave portion 10 is set to be 10% to 50% of the depth E of the coupling concave portion 5 from the body-extending surface M2. That is, it is preferable to satisfy the relationship $0.5\times E \geq C \geq 0.1\times E$. The depth C may be found from the heights of the sides 12 to 14.

When the depth C of the concave portion 10 is less than 10% of the depth E of the coupling concave portion 5, the flow protruding portion that greatly protrudes toward the coupling concave portion 5 protrudes into the coupling region between the coupling concave portion 5 and the coupling convex portion 4 that is the counterpart coupled to the coupling concave portion 5. Further, in this case, the flow protruding portion that protrudes outward further than the front side and the rear side of the body increases the gap between adjacent double-sided teeth in coupling or interferes with sliding of the slider.

When the depth C of the concave portion 10 is larger than 50% of the depth E of the coupling concave portion 5, and when the coupling convex portion 4 is coupled to the coupling concave portion 5 at the coupling place, the gap formed around the coupling convex portion 4 coupled to the concave portion 10 increases and the region of the coupling convex portion 4 coupled to the concave portion 10 decreases. Accordingly, the coupling state is unstable, and as a result, the coupling strength reduces.

When the metal double-sided tooth 1 is configured by using soft metal such as aluminum or an aluminum alloy, the flow protruding portion formed at the body 6 when the pair of legs 2 are caulked is formed higher than a flow protruding portion formed when the metal double-sided tooth is configured by using copper or a copper alloy. However, in the invention, it is possible to prevent the flow protruding portion formed at the body 6 from greatly expanding out, even when the metal double-sided tooth 1 is configured by using soft metal such as aluminum or an aluminum alloy, by restricting the shape of concave portion 10.

Figure 5:
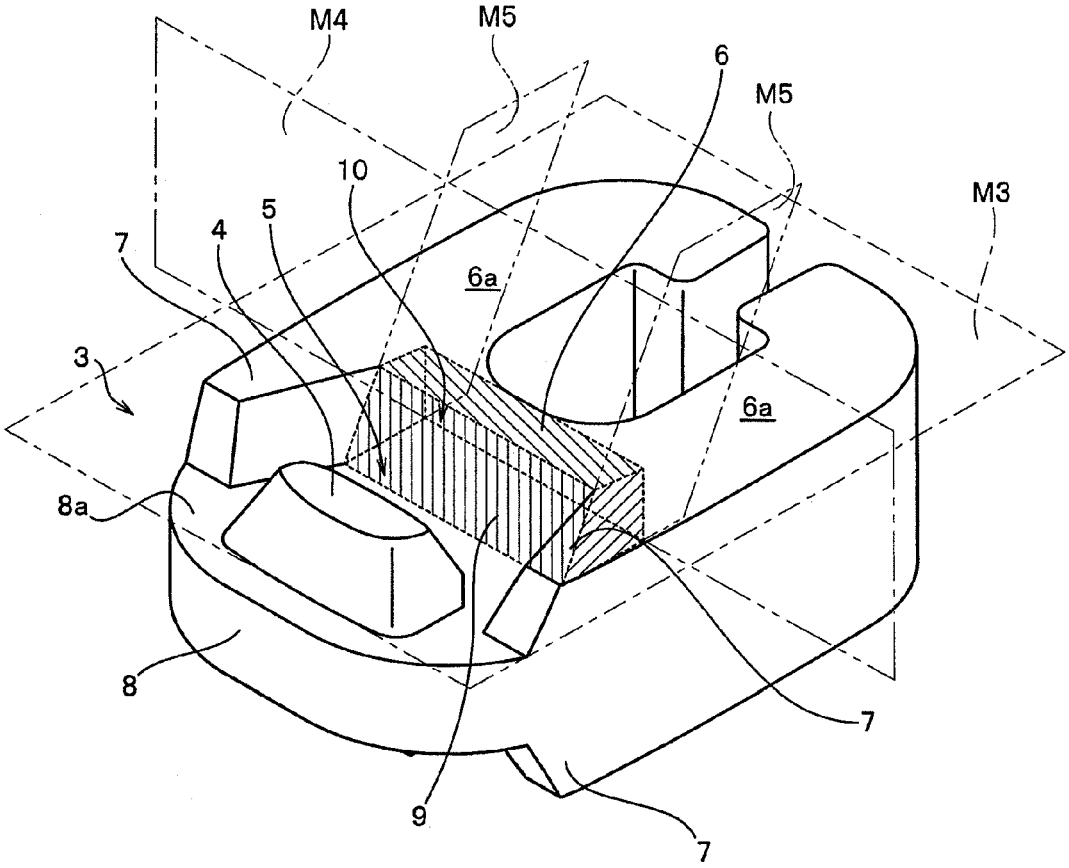
FIG. 5 is a perspective view illustrating the volume of a concave-shaped portion (illustrative view).

Further, when the configuration of the concave portion 10 is specified by using the volume of the concave portion 10, it may be specified as follows. That is, as illustrated in FIG. 5, when the concave portion 10 is not formed, the volume V in the body 6 which is surrounded by a flat plate-extending surface M3, a rear side M4, and a pair of sides M5 is assumed. The volume V is hatched in FIG. 5.

The flat plate-extending surface M3 is an extending surface that extends the front side 8*a* or the rear side 8*b* of the flat plate portion 8, and the rear side M4 is a vertical surface that is perpendicular to the flat plate-extending surface M3 and passes the point where the distance from the first intersection line K at the rear edge 6*c* of the body 6 is the minimum distance. Further, the pair of sides M5 are a pair of surfaces that are defined by an intersection line between the boundary 9 and the inner sides of the side protruding portions 7 and the vertical surface from the rear side M4 including the intersection line.

When the assumed volume V is a volume of 100%, the concave portion 10 may be configured to have a volume of 5% to 13% of the volume V.

It is possible to efficiently prevent the flow protruding portion generated in caulking from protruding into the coupling region between the coupling concave portion 5 and the coupling convex portion 4 that is the counterpart coupled to the coupling concave portion 5, or protruding outward further than the body-extending surface M2 by making the volume of the concave portion 10 within the range.

Figure 7:
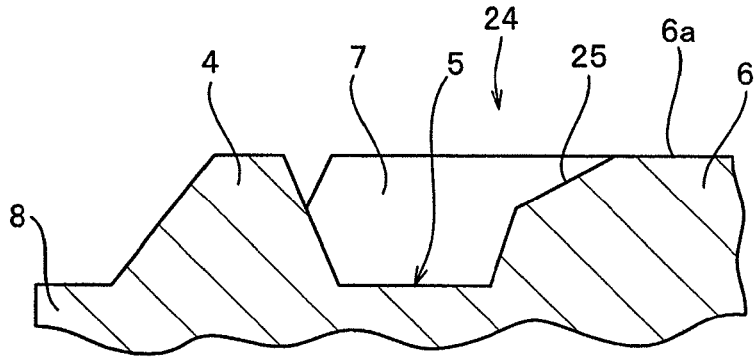
FIG. 7 is a cross-sectional view illustrating the main parts in a modified example of the coupling head (Embodiment).
Figure 8:
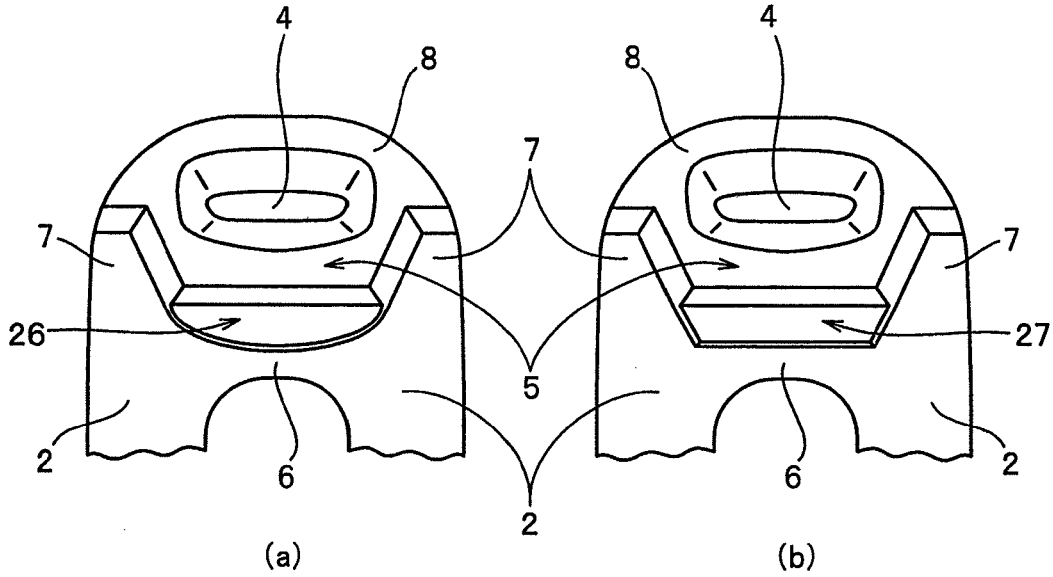
FIG. 8 is a plan view illustrating the main parts in another modified example of the coupling head (Embodiment).
Figure 9:
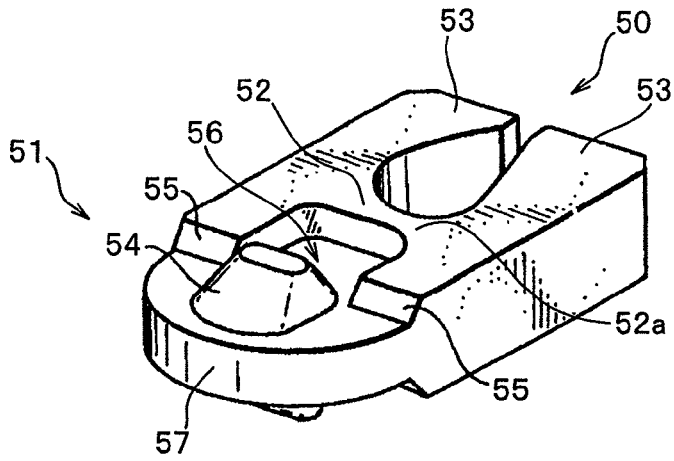
FIG. 9 is a perspective view of a metal double-sided tooth (Example of related art).

Although the configuration when the tetragonal shape of the concave portion 10 is formed in an imaginary three-dimensional shape with six surfaces, is described above, the shape of the bottom, as illustrated in FIG. 7, for example, the bottom of a concave portion 24 may be configured as an inclined surface 25 inclined upward toward the rear portion from the side 11*a*.

Further, the inclined surface 25 that is inclined upward may be configured as a plane or a curved surface. In addition, the side of the rear side of the inclined surface inclined upward may be positioned on the front side 6*a* or the rear side 6*b* of the body 6, or may be positioned lower than the front side 6*a* or the rear side 6*b* of the body 6.

The shape of the concave portion 10 is not necessarily the same as those of the front side 8*a* and the rear side 8*b* of the flat plate portion 8. As described above, as the shape of the concave portion 10 formed on the front side 8*a* of the flat plate portion 8 and the shape of the concave portion 10 formed on the rear side 8*b* of the flat plate portion 8 are formed to be different, for example, the direction of the front and rear sides of the metal double-sided tooth 1 can be set.

In the above description, the limits on the dimensions when the concave portion 10 is formed in an imaginary three-dimensional shape with six tetragonal surfaces were described, but the shape of the concave portion may be specified by the volume of the concave portion 10 when being formed in an imaginary three-dimensional shape with six tetragonal surfaces. That is, in the above description, the limits on the lengths B of the upper sides 12*a* and 14*a*, the limits on the length A of the upper side 13*a*, and the limits on the heights C of the sides 12 to 14 were described.

In other words, the volume of the concave portion 10 when being formed in an imaginary three-dimensional shape with six tetragonal shape may be specified by using the lengths of the upper sides 12*a* and 14*a*, the length of the upper side 13*a*, the heights of the sides 12 to 14, and the inclination state of the boundary 9. By using the imaginary three-dimensional shape configured as described above, it is possible to specify the shape and the volume of the concave portion 10 as a configuration included in the imaginary three-dimensional shape. In this configuration, it is preferable that the volume of the concave portion 10 is 5% to 13% of the volume V described above.

That is, as the concave portion 10 is configured to have the shape included in the imaginary three-dimensional shape, it is possible to prevent the flow protruding portion from protruding into the coupling concave portion 5 further than the boundary 9. Further, the concave portion 10 may be configured in order not to protrude from the imaginary three-dimensional shape.

As the volume of the concave portion is configured to be within the volume range, even if the concave portion 10 is not configured by a hexahedral body, a column-shaped concave portion 26 surrounded by an arc and a chord when seen from above may be configured, for example, as illustrated in FIG. 8A. Further, the concave portion may be configured such that a column-shaped concave portion is formed in a partial shape on the circumference of an ellipse or a parabolic shape, instead of the arc shape, when seen from above. In addition, the concave portion may be configured to have a shape with a concave surface on the bottom.

Further, as illustrated in FIG. 8B, a concave portion 27 may be configured such that the shape of the bottom is a trapezoidal shape when seen from above. In this configuration, extending surfaces that extend the inner sides of the side protruding portions 7 may be configured to be both opposite sides of the concave portion 27.

Figure 6:
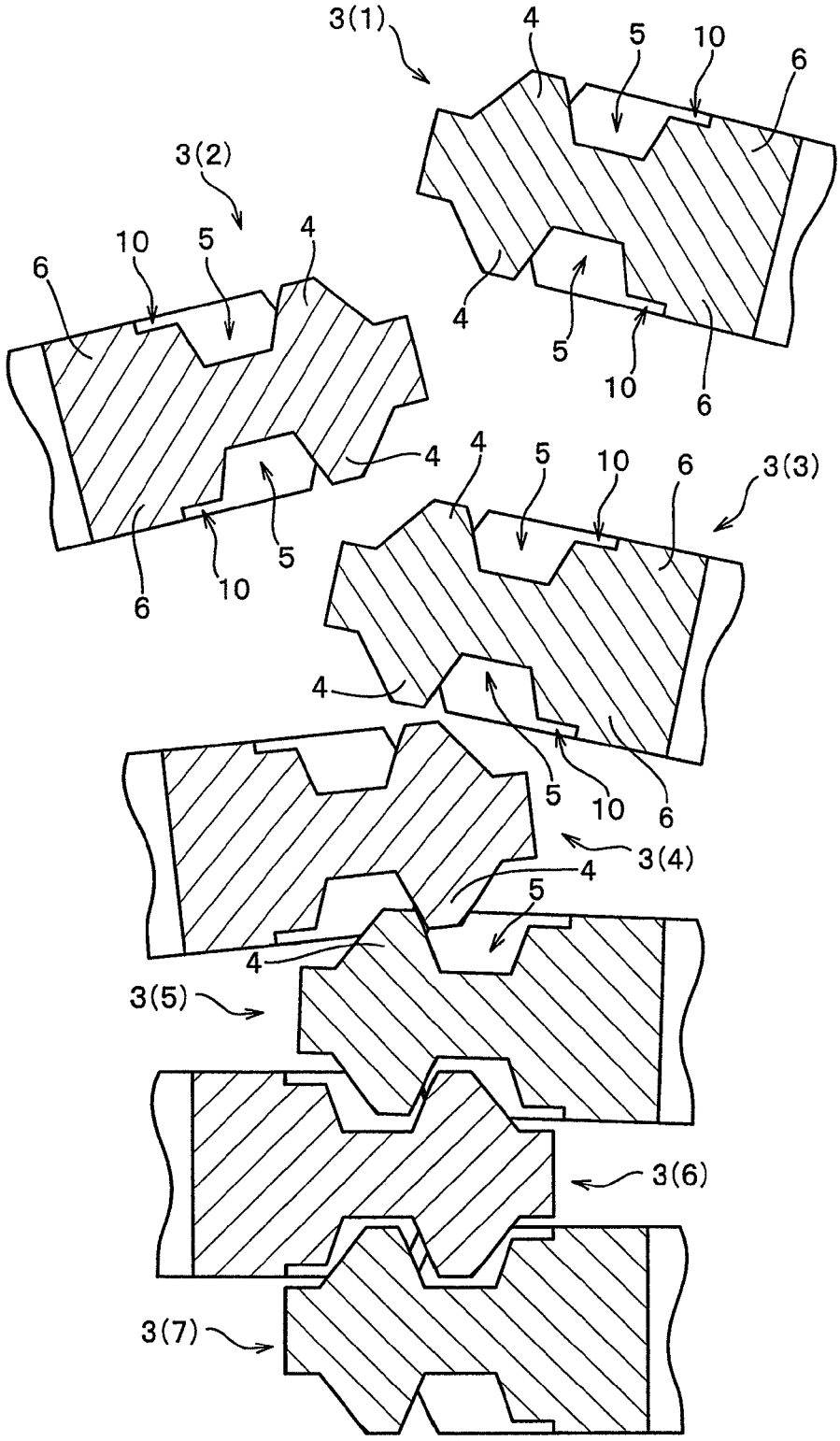
FIG. 6 is a cross-sectional view of main parts illustrating the state of coupling of a metal double-sided tooth (Embodiment).

FIG. 6 is a cross-sectional view illustrating the state when a pair of fastener stringers 21 (see FIG. 1) to which the metal double-sided tooth 1 is attached are coupled by a slider, which is not illustrated. As illustrated in FIG. 6, in the metal double-sided tooth 1 attached to the fastener tape, the flow protruding portion generated in attachment by caulking does not protrude into the coupling region between the coupling concave portion 5 and the coupling convex portion 4 that is the counterpart coupled to the coupling concave portion 5, so that it is possible to smoothly couple the metal double-sided teeth 1 to each other.

Further, when the coupled metal double-sided teeth 1 are separated from each other, it is possible to smoothly remove the coupling state of the coupling convex portions 4 which are coupled to each other, and the coupling state between the coupled coupling convex portion 4 and coupling concave portion 5.

INDUSTRIAL APPLICABILITY

The invention may be appropriately used in a tooth for a slide fastener that is attached to the openings of bags or clothes.

DESCRIPTION OF REFERENCE NUMERALS

1 Metal double-sided tooth
3 Coupling head
4 Coupling convex portion
5 Coupling concave portion
6 Body
9 Boundary
10 Concave portion
12*a*-14*a* Upper side
20 Slide fastener
24, 26, 27 Concave portion
25 Inclined surface
50 Metal double-sided tooth
54 Coupling convex portion
56 Coupling concave portion
58 Flow protruding portion
K First intersection line
L Second intersection line
M1 Extending boundary
M2 Body-extending surface
M3 Flat plate-extending surface
M4 Rear side
M5 Side

The invention claimed is:

1. A metal double-sided tooth having a coupling head, a body disposed at the rear end of the coupling head, and a pair of left and right legs extending from the rear end of the body, wherein the body has a front side and a rear side, the coupling head includes a flat plate portion, and a thickness of the flat plate portion is smaller than a thickness of the body from the front side to the rear side;

a pair of coupling convex portions protruding from a front side and a rear side of the flat plate portion, front-side protruding portions disposed on left and right sides of the coupling convex portion on the front side of the flat plate portion and protruding to a height equal to a height of the front side of the body, rear-side protruding portions disposed on left and right sides of the coupling convex portion on the rear side of the flat plate portion and protruding to a height equal to a height of the rear side of the body, and a pair of coupling concave portions, wherein a front side coupling concave portion is surrounded by the coupling convex portion on the front side of the coupling head, the front-side protruding portions, and the body, and a rear side concave portion is surrounded by the coupling convex portion on the rear side of the coupling head, the rear-side protruding portions;

an upper surface of the front side protruding portions and the front side of the body are on the same plane, and an upper surface of the rear side protruding portions and the rear side of the body are on the same plane;

a front boundary between the front side coupling concave portion and the front side of the body is an inclined surface, and a rear boundary between the rear side coupling concave portion on the rear side of the coupling head and the rear side of the body is an inclined surface;

a front concave portion is formed on the front boundary and has an inclined bottom and a rear concave portion is formed on the rear boundary and has an inclined bottom, wherein an inclination angle of the inclined bottom of the front concave portion is different than an inclination angle of the front boundary, and an inclination angle of the inclined bottom of the rear concave portion is different than an inclination angle of the rear boundary; and the front concave portion has a concave shape open to a top side of the metal double-sided tooth and the rear concave portion has a concave shape open to a rear side of the metal double-sided tooth.

2. The metal double-sided tooth of claim 1, wherein the inclined bottom of the front concave portion is formed in a tetragonal shape when seen from above and has three sides surrounding three sides of the inclined bottom.

3. The metal double-sided tooth of claim 2, wherein a dimension A in the left-right width direction of the front concave portion is not more than a length G of a side at the front side coupling concave portion of the inclined bottom and is not less than a length F in the left-right direction at the top of the coupling convex portion on the front side of the coupling head.

4. The metal double-sided tooth of claim 2, wherein assuming an intersection line L of a vertical surface perpendicular to the inclined bottom including the side at the front side coupling concave portion of the inclined bottom and body-extending surface M2 of the front side of the body, a dimension B in the front-rear direction of the front concave portion is the length that is 40% to 60% of a minimum distance D between the intersection line L and a rear edge of the body.

5. The metal double-sided tooth of claim 2, wherein a dimension C in the depth direction of the front concave portion is a length that is 10% to 50% of depths E of the front side coupling concave portion.

6. The metal double-sided tooth of claim 1, wherein when the front concave portion is not formed and the front boundary is formed up to the upper surface of the body, and a volume V in the body which is surrounded by a flat plate-extending surface M3 extending the front side of the flat plate portion, a rear side M4 which is a surface parallel with a surface perpendicular to the flat plate-extending surface M3 and passes a portion closest to the coupling head at the rear edge of the body, and a pair of sides M5 that include an intersection line between the front boundary and the front side protruding portions and are vertical surfaces from the rear side M4, when the volume V is a volume of 100%, the front concave portion is formed to have a volume that is 5% to 13% of the volume V.

7. A slide fastener including a pair of fastener stringers in which the metal double-sided teeth of claim 1 are arranged at a predetermined distance at a side of a fastener tape.

* * * * *

UNITED STATES PATENT AND TRADEMARK OFFICE

CERTIFICATE OF CORRECTION

PATENT NO. : 9,101,182 B2
APPLICATION NO. : 13/635430
DATED : August 11, 2015
INVENTOR(S) : Futoshi Kozato et al.

It is certified that error appears in the above-identified patent and that said Letters Patent is hereby corrected as shown below:

On the title page, item 56, in column 2, under "Other Publications", line 1, delete "Intenrational" and insert -- International --, therefor.

Signed and Sealed this
Twenty-ninth Day of December, 2015

Michelle K. Lee

Michelle K. Lee
*Director of the United States Patent and Trademark Office*